US006553727B2

(12) United States Patent
Thomas et al.

(10) Patent No.: US 6,553,727 B2
(45) Date of Patent: Apr. 29, 2003

(54) COLUMBARIUM

(75) Inventors: Marion Erskine Thomas, Central, SC (US); Ron Scarcella, Greer, SC (US); Harry Lee Jordan, Anderson, SC (US)

(73) Assignee: M. Erskine Thomas, Central, SC (US)

( * ) Notice: Subject to any disclaimer, the term of this patent is extended or adjusted under 35 U.S.C. 154(b) by 0 days.

(21) Appl. No.: 09/760,559

(22) Filed: Jan. 16, 2001

(65) Prior Publication Data

US 2002/0092247 A1 Jul. 18, 2002

(51) Int. Cl.[7] ..... E04H 7/22; E04H 7/00

(52) U.S. Cl. ..... 52/136; 52/134; 52/137; 52/142; 52/27; 312/109; 16/49

(58) Field of Search ..... 312/111, 108, 312/107, 109; 16/49, 65, 82, 71, 85, 59, 70; 52/134, 136, 137, 139, 142, 27; 27/1; 292/197

(56) References Cited

U.S. PATENT DOCUMENTS

| | | | | | |
|---|---|---|---|---|---|
| 750,157 | A | * | 1/1904 | Bonus | 52/136 |
| 835,333 | A | * | 11/1906 | Tauveron | 16/70 |
| 1,340,656 | A | * | 5/1920 | Hughes et al. | 52/136 |
| D104,741 | S | | 6/1937 | Grubbs | |
| 3,082,617 | A | * | 3/1963 | Herman | 16/71 |
| 3,361,508 | A | * | 1/1968 | Chassevent | 312/114 |
| 3,529,879 | A | * | 9/1970 | Priest | 312/111 |
| 3,717,395 | A | * | 2/1973 | Spielvogel et al. | 312/114 |
| 3,967,843 | A | * | 7/1976 | Hart | 292/273 |
| 4,521,999 | A | | 6/1985 | Flanagan | 52/103 |
| 4,989,382 | A | | 2/1991 | Spronken | 52/252 |
| 5,134,758 | A | | 8/1992 | Christiansen | 27/35 |
| 5,605,389 | A | * | 2/1997 | Kelly et al. | 312/258 |
| 5,622,014 | A | | 4/1997 | Weiss | 52/105 |
| 5,692,344 | A | | 12/1997 | Zarth | 52/137 |
| D395,121 | S | | 6/1998 | Eickhof | D99/5 |
| 5,765,269 | A | | 6/1998 | Zarth | 27/26 |
| 5,979,124 | A | | 11/1999 | Branan | 52/136 |
| 6,295,705 | B1 | * | 10/2001 | Gersten | 27/1 |
| D451,258 | S | * | 11/2001 | Carrier | D99/17 |

FOREIGN PATENT DOCUMENTS

| | | | | |
|---|---|---|---|---|
| EP | 000481949 | * | 4/1992 | 312/111 |
| WO | WO93/03243 | * | 2/1993 | 52/136 |

* cited by examiner

*Primary Examiner*—Jose V. Chen
*Assistant Examiner*—Phi Dieu Tran A
(74) *Attorney, Agent, or Firm*—McNair Law Firm, P.A.

(57) ABSTRACT

A columbarium for cremation remains constructed of at least one unit which includes a generally planar bottom surface and at least five vertical outer sides with each side having a corner. A cover supported by a plurality of walls which, along with said outer sides and said bottom, form compartments. An opening in each outer side providing access to a compartment for receiving cremation remains.

23 Claims, 8 Drawing Sheets

COLUMBARIUM

BACKGROUND OF THE INVENTION

This invention is directed to a columbarium having at least five outer upstanding sides. The columbarium may be one level, multi-level, ground level or elevated.

Columbarium's are well known and of many sizes and shapes. For example, U.S. Patent Des 395,121 shows a round shaped columbarium. U.S. Pat. Nos. 5,692,344 and 5,765,269 show columbaria formed in pyramid shape. U.S. Pat. Nos. 5,979,124 and 4,521,999 show columbaria of rectangular shape.

It is an object of the instant invention to provide a columbarium structure which is both durable and pleasing to the eye.

Another object of the invention is a columbarium structure which may be enlarged.

Another object of the invention is to provide a columbarium structure which is both durable and inexpensive to construct.

Another object of the invention is to provide a columbarium with compartments of adjustable size.

Another object of the invention is to provide a columbarium with doors or cover hangers which are easily released and securely locked.

Another object of the invention is a columbarium with elevating support structure.

SUMMARY OF THE INVENTION

The instant invention is directed to a columbarium which is constructed to have at least one unit with a generally planar bottom surface and a plurality of vertical outer sides each having a corner and at least one opening which provides access to a compartment for receiving cremation remains. The columbarium is formed preferably with six outer sides and is constructed primarily of concrete. Each outer side may have three openings with each being defined by inwardly extending vertical divider walls separating top and bottom surfaces. Preferably the inwardly extending walls terminate in a common interior vertical rear wall.

Generally, a plurality of units of substantially the same dimensions are stacked one on top of the other to form a stacked array of units. Each unit includes a plurality of vertical support walls with each vertical support wall having a top surface with an elongated locking member formed thereon. Likewise, the bottom surface of each unit is provided with a plurality of mating elongated locking members which are adapted to be positioned so that they mate with respective of the support wall locking members from the next lower unit in the stacked array. In this manner a stable multi-level columbarium of stable construction is formed.

A closure door is associated with each of the openings. Each door is constructed to have at least on its outer surface a permanent, decorative material selected from the group consisting of marble, granite, brass, bronze, aluminum, plastic, glass, fiberglass, lead, masonry, ceramic, and concrete. Each door includes an upper and a lower locking member secured with its inner side. The locking members are designed to engage with the top and bottom surfaces of each compartment.

A columbarium formed of a multiplicity of vertically stacked interlocked units. Each unit is formed to have a generally planar, hexagonal base with a plurality of upstanding inner walls formed over one surface to form a central hexagon shaped hall. A plurality of upstanding divider and support walls are located around the perimeter of the hall defining a plurality of outwardly facing open compartments. Each of the support walls is arranged to extend from each outer corner of the base to an aligned corner of the inner peripheral walls. The divider walls are positioned between each adjacent pair of support walls to divide the space between the support walls into substantially equal volumes. A cover is provided for the uppermost unit of the stacked units. The arrangement forms compartments which are defined by the inner side, the respective divider and/or support walls, upper and lower surfaces of the base, and in the case of the uppermost unit, the lower surface of the cover. A door is provided for closing each of the chambers.

The units may be constructed whereby all of its walls and the base are formed from the same continuous material, preferably molded concrete. The units may be formed from other materials such as those selected from the group consisting of granite, marble, stone, plastic, and aluminum.

The top surface of each of the support walls is provided with an interlocking configuration. Also, the bottom surface of the cover and each base is provided with a mating interlocking configuration positioned to mate with the aligned configuration of each support wall locking the stacked units in position.

There are a multiple of construction arrangements. In one, units are formed from molded concrete with the thickness of all vertical walls being less at the top than at the base to facilitate mold release. In another, the divider walls are removable providing variable sizes for the chambers.

The lowermost of the stacking units may be supported on a ground level surface. Alternatively, it may be supported in an elevated position above ground level. An open faced support podium having a plurality of support walls may be utilized for supporting the lowermost unit in an elevated position.

A columbarium formed as a unitary unit having a base with a center axis and at least five vertical outer faces with each face being separated from an adjacent faces by a corner. A plurality of upstanding support walls extend from each of the corners toward the axis and a cover which is supported by the support walls extends slightly beyond the outer extremities thereof. The cover forms with the base and the support walls a plurality of compartments with each compartment having an outwardly directed opening. A door is provided for covering each opening of each compartment so that cremated remains may be stored in each compartment.

A columbarium which includes a base having a generally circular outer configuration forming more than four outer planar vertical sides, each defined by a pair of corners. A generally circular inner area defined by a plurality of vertical inner sides. At least three support components, each having first and second interconnected side support walls are supported in spaced position about the base. A cover is engaged by an upper surface of the support walls forming with the base and the inner sides, a plurality of compartments for receiving cremation remains. A plurality of divider walls and side panels are interfitted between and with the cover and base forming additional compartments. A removable door allowing access and closure of each compartment is provided.

Each door is generally rectangular and of a size slightly larger than the opening which it covers. This provides for complete closure of the opening with the door in position. Each door includes an inner and an outer surface with upper and lower locking members secured with the inner surface thereof. At least one of the locking members include a spring biased pin. Locking grooves are formed in the lower surface of the cover and the upper surface of the base adjacent the opening of each compartment. The upper and lower locking members are adapted to engage in respective of these grooves securing the door in position. There is also a channel formed in the lower surface of the cover which extends over and across each opening. The channel is of such a depth as to receive the upper edge of the doors when they are positioned to close the openings and to also allow upward movement of the door which compresses the spring biased locking unit allowing the other locking member to be freed of its associated groove thus unlocking the door for removal.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
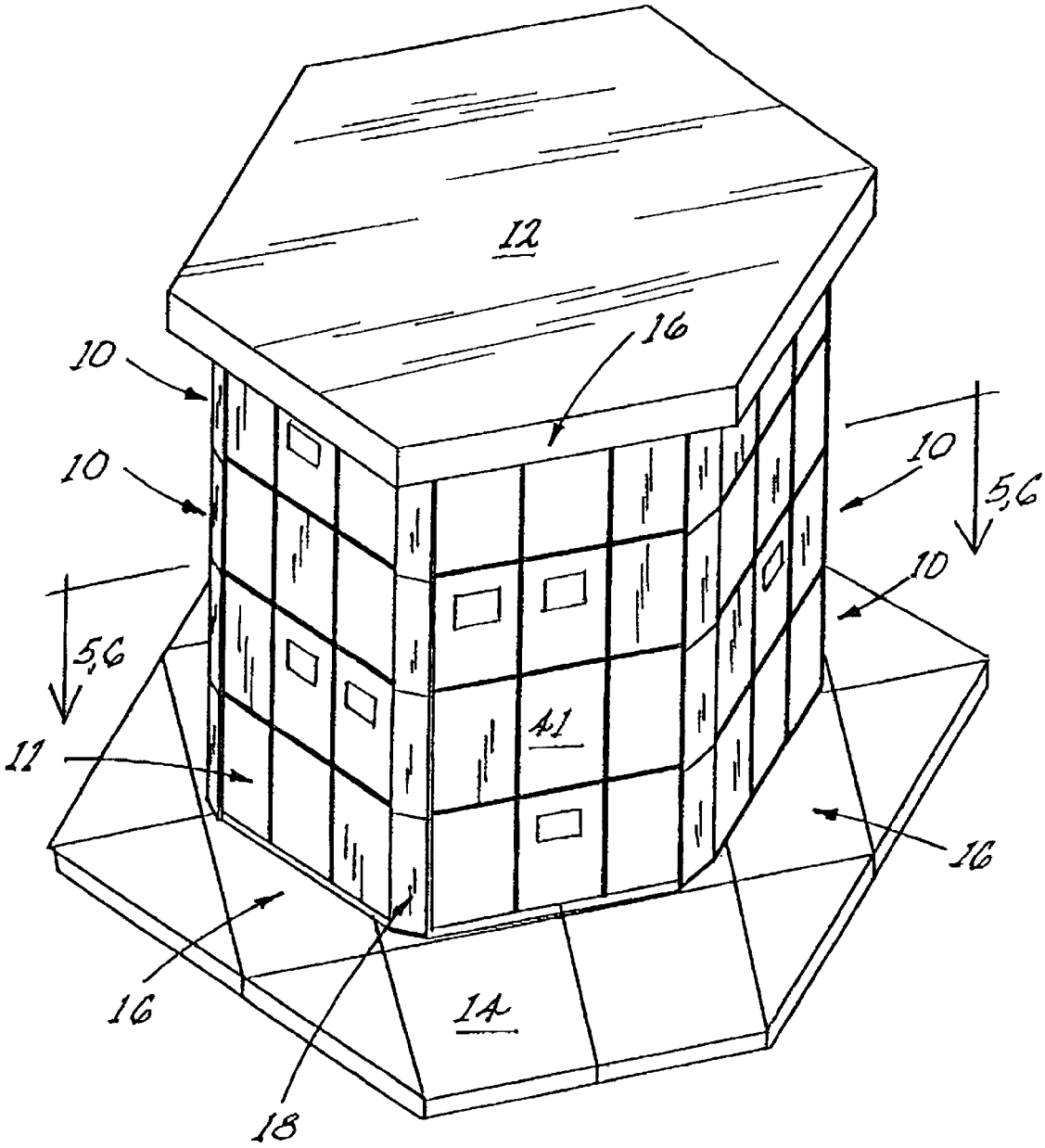
FIG. 1 is a perspective of a first arrangement of the columbarium of the invention.

Turning now to FIG. 1, the columbarium shown comprises four units 10 stacked vertically one on the other and covered with top 12. The lowermost unit 10 is supported at substantially ground level by base 14 which may be paved as shown or unpaved. Each unit 10 of the columbarium comprises six vertical outer sides 16 each separated from the other by a corner 18. It is noted that the number of vertical sides may be more than six but not less than five.

Figure 2:
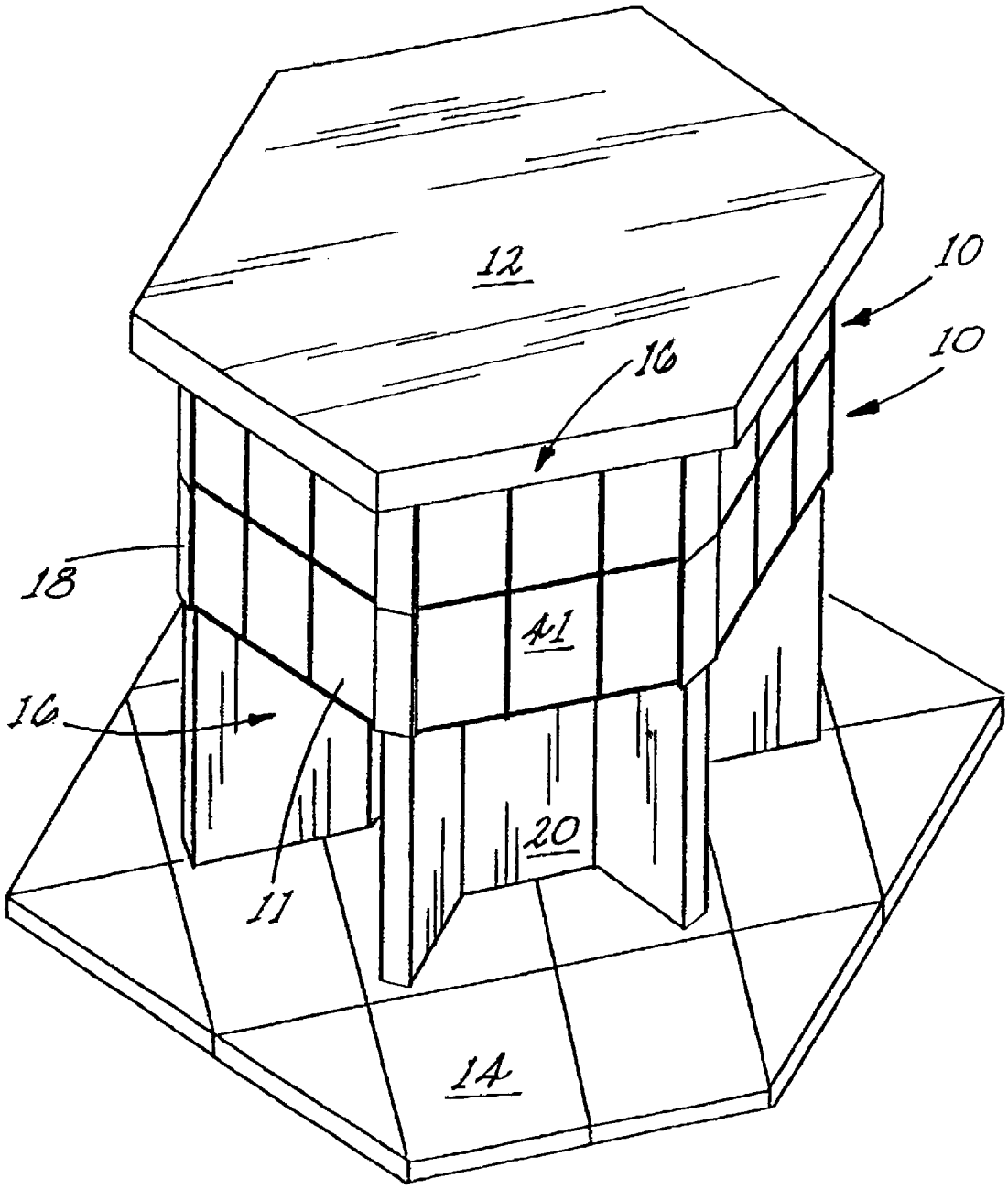
FIG. 2 is a second arrangement of the columbarium of the invention.

A second arrangement is shown in FIG. 2 where columbarium B comprises a plurality units 10 with cover 12 located over the uppermost unit. In this arrangement a podium 20 is arranged beneath lowermost unit 10 locating the vertical stack of units in an elevated position. The particular structure of podium 20 is variable so long as it is sufficiently strong to hold-the stack of units in a stable condition. Podium 20 may be supported on the ground or it may be supported on a paved base 14 as shown.

Figure 3:
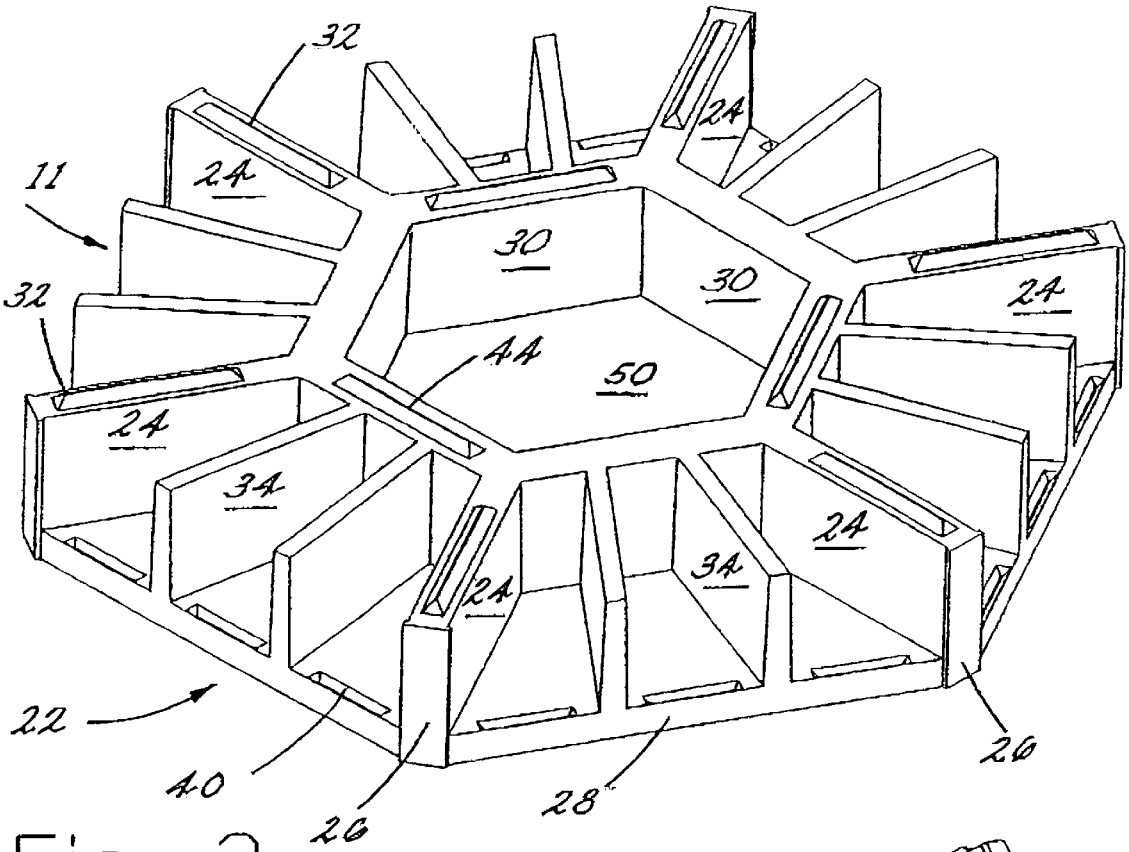
FIG. 3 is a perspective top view of a section of the columbarium of the invention.
Figure 4:
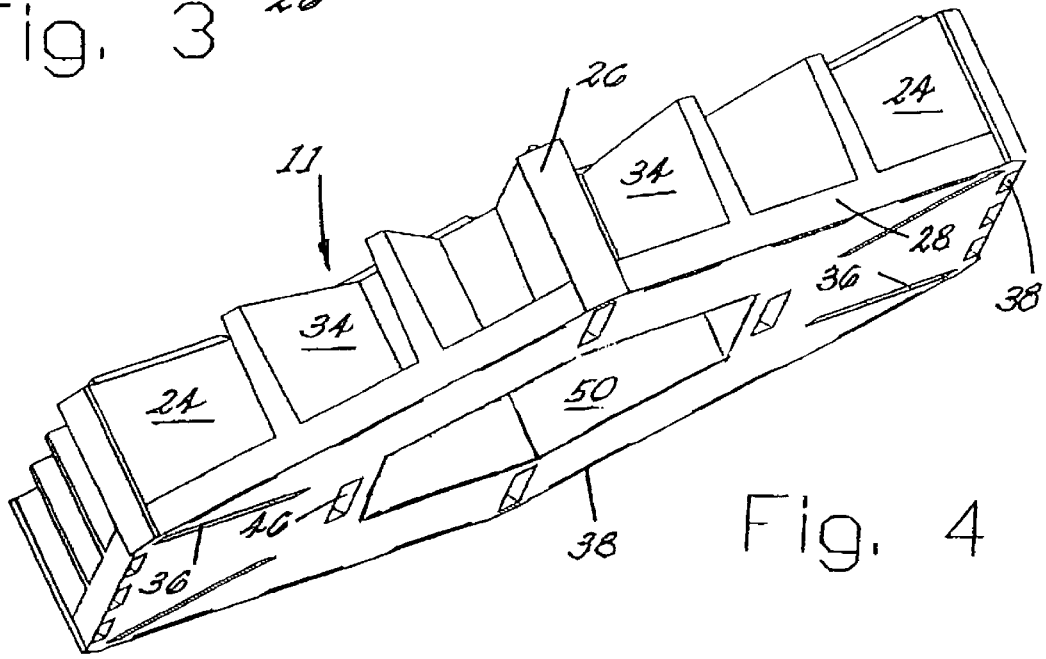
FIG. 4 is a perspective bottom view of the section shown in FIG. 3.
Figure 5:
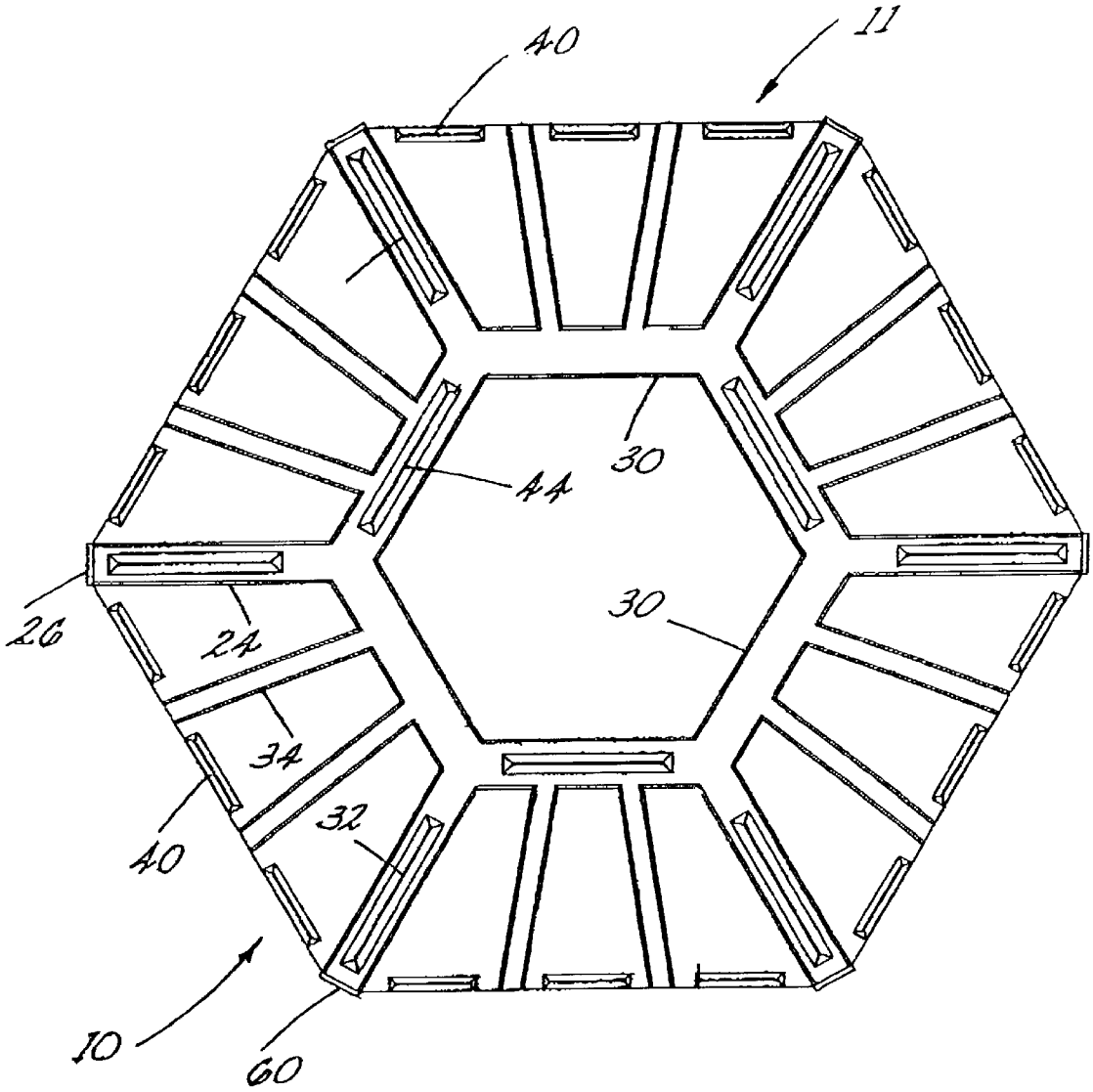
FIG. 5 is a top view of the section shown in FIG. 3.
Figure 6:
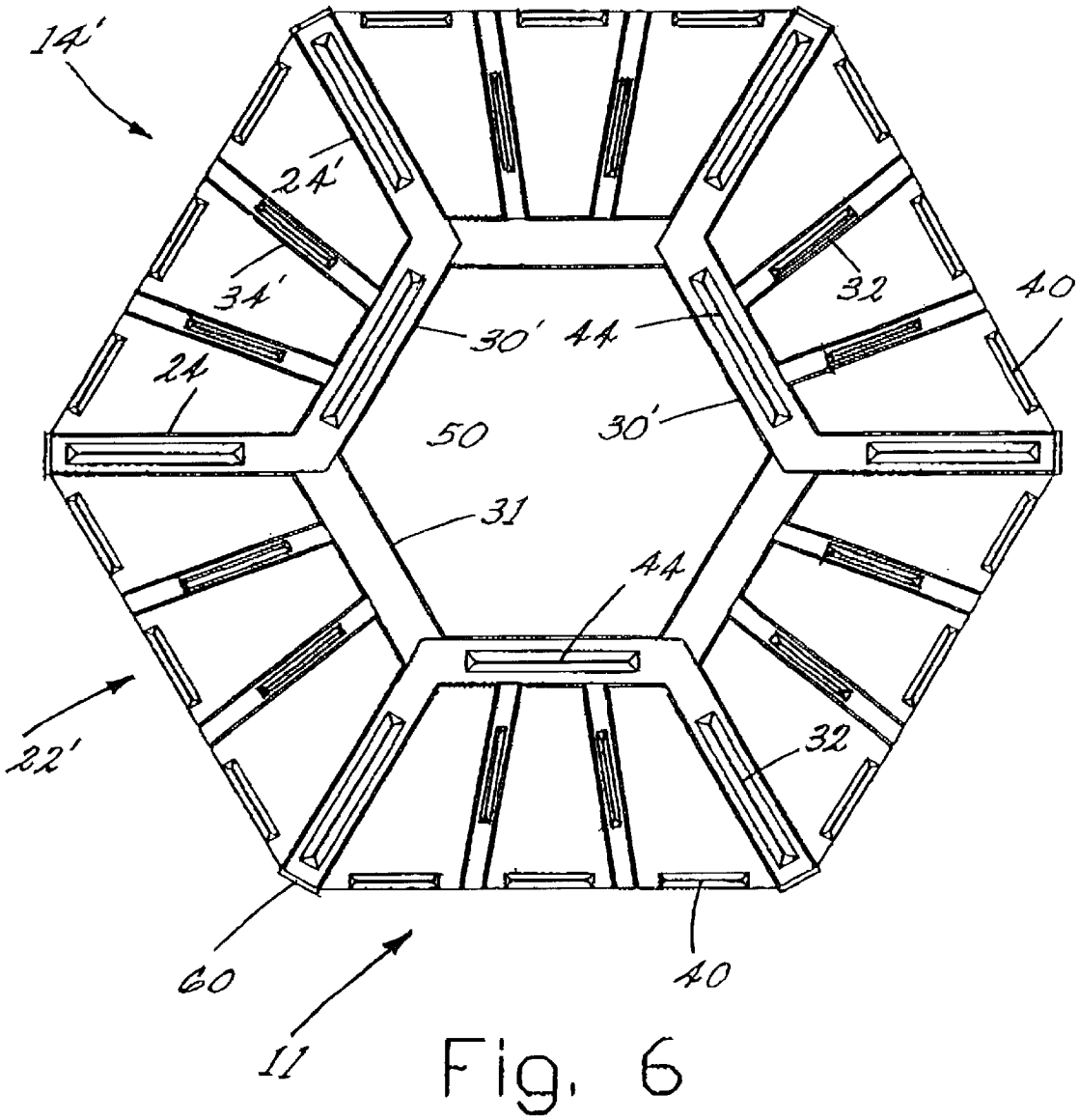
FIG. 6 is a top view of a second arrangement section of the columbarium unit.
Figure 8:
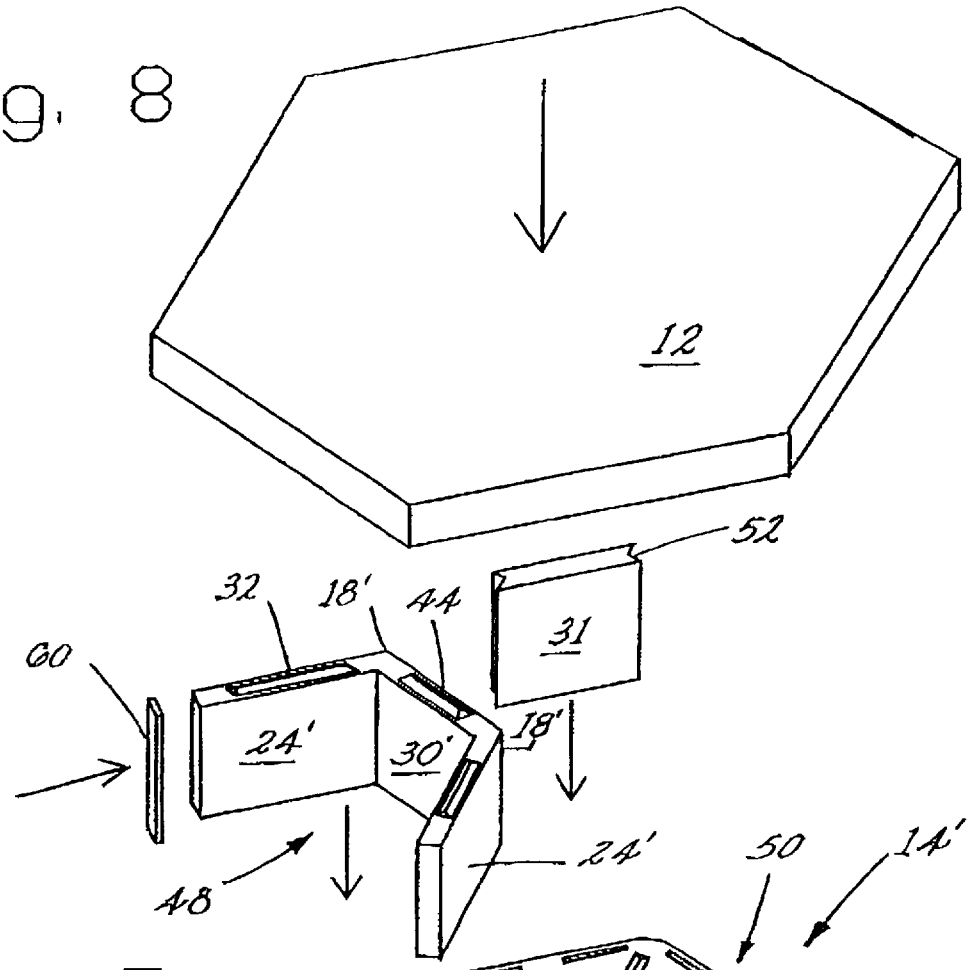
FIG. 8 is a perspective view of the cover for the upper unit of the columbarium utilizing any of the arrangements shown in FIGS. 1 2, 4, and 5.
Figure 7:
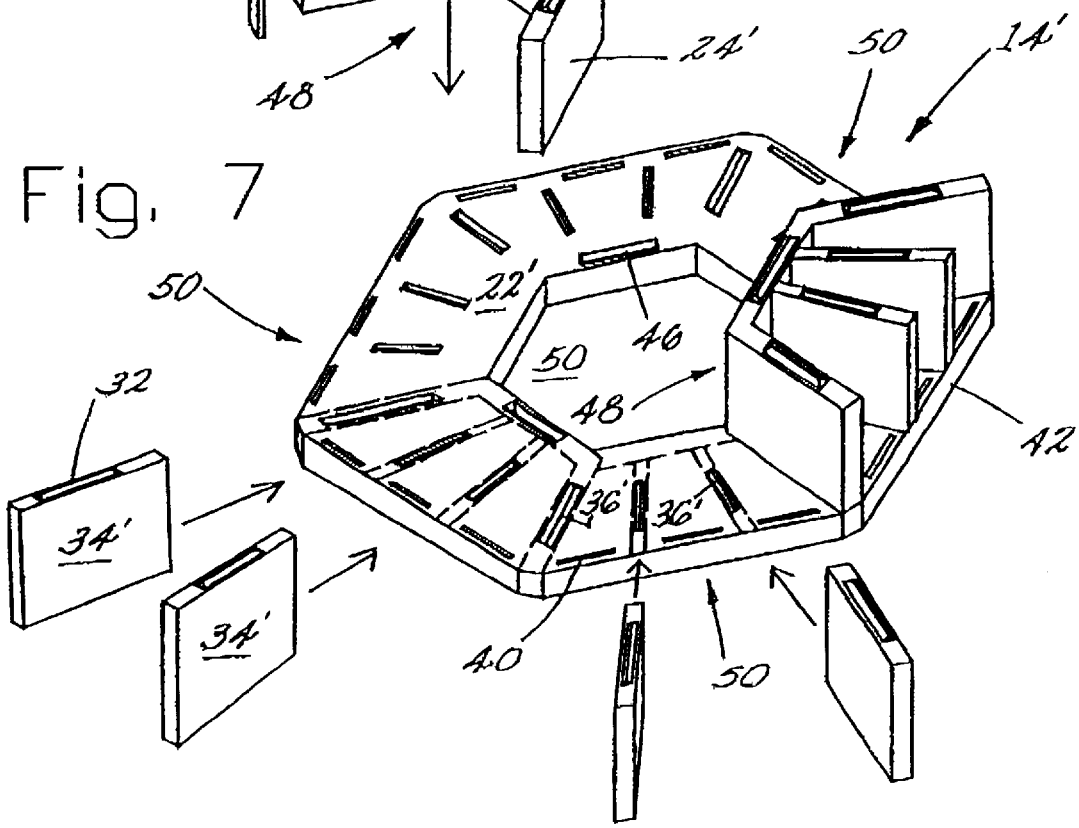
FIG. 7 is an exploded perspective view of the second arrangement shown in FIG. 6.
Figure 9:
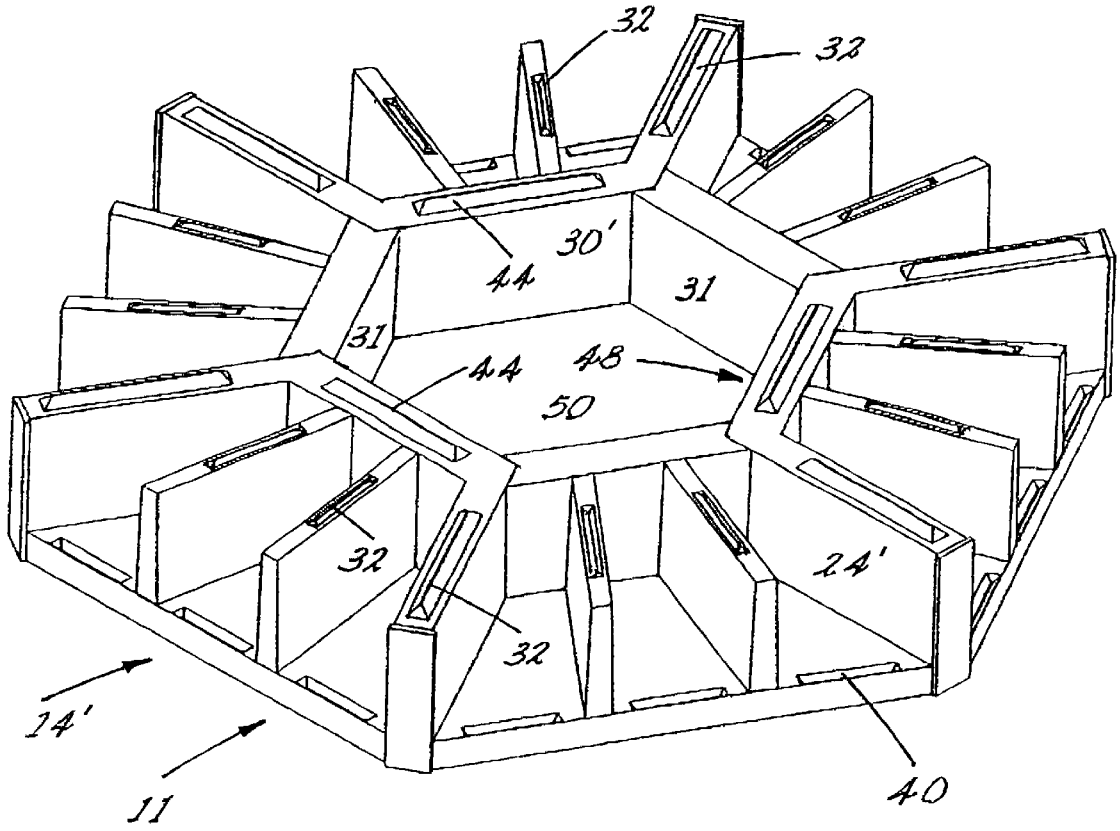
FIG. 9 is a perspective view of the second arrangement shown in FIG. 6.
Figure 12:
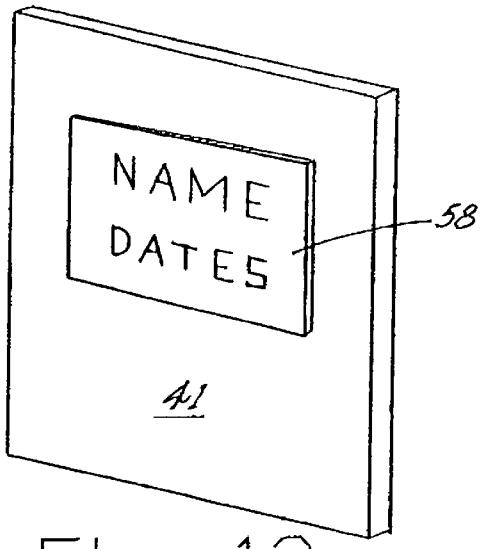
FIG. 12 is a perspective view of the door front.
Figure 13:
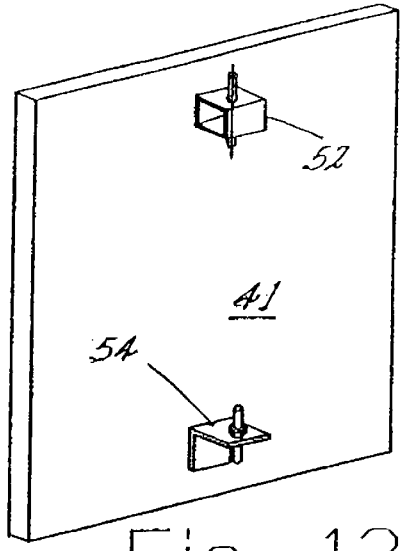
FIG. 13 is a perspective view of the door back.

FIGS. 3–5 show a first construction for unit 10. In this construction unit 10 comprises a unitary construction comprising a hexagonal shaped base 22 which is formed with six vertical support walls 24 which extend outwardly forming corners 26 of vertical outer sides 28. Inner ends of support walls 24 are formed integral with vertical inner sides 30 forming a generally circular inner area.

The upper surface of each support wall along with the upper surface of alternate inner sides 30 are formed to include a fastening element in the form of a raised elongated wedge 32 or 44. Wedge 32, 44 may be formed into more than one wedge or some other type of suitable connector.

Normally, there is between each adjacent support wall 24 is at least one but most times two divider walls 34. The divider walls may be formed integral with inner sides 30 and base 22 or they may be formed separate to be integrated into or removed from each unit 10 as desired.

Preferably the integral structure just described is formed with walls 24, 34 and inner sides 30 having a slight taper, providing less thickness at the top than at the bottom. This is to facilitate mold release.

Each bottom 22 as well as cover 12 has formed on its lower surface a plurality of elongated connectors or slots 36 and 46 which are located and sized to receive wedge members 32, 44 to securely position the stacked units or the top 12 in position. As is evident, all slots 36, 46 and wedge members 32, 34 of each unit are aligned.

Compartments 11 are formed between inner sides 30, the lower surface of top 12, the upper and lower surfaces of base 22, vertical outer sides 28, and support and divider walls 24, 34. In the case where divider walls 34 are removable, compartment size can be adjusted as desired.

Grooves 38 and 40 are formed along the outer edges of the upper and lower surface of base 22 generally centrally of each opening of each compartment 11. These grooves are provided to secure latch members on doors 41 to lock the doors in removable positions. Doors 40 along with corners 18 form the surface of vertical outer sides 16. The door connector or latch structure will be described in more detail herein after.

Turning now to FIGS. 6–9, a second arrangement for forming the columbarium of the invention is shown. In the second structure, units 14' comprise base 22' which is formed as a generally planar member having six outer and inner vertical sides or faces. Base 22' has a plurality fastening elements in the form of a plurality of slots 36', generally eighteen, formed in a generally circular manner about its upper and lower surfaces. Also, there are three additional elongated slots 46' formed on the top of each 22'. Slots 36', 46' are formed in equally spaced and vertically aligned positions with slots 36, 46 formed on its lower surface. About the outer edges and on the upper and lower surfaces of base 22' are formed eighteen elongated grooves 38. Cover 12, which is unchanged between embodiments, has on its lower surface an identical array of elongated slots and grooves.

Three U-shaped support components 48 are provided. Each support component comprises two vertical support walls 24' interconnected at their inner end with a vertical inner side 30' forming corners 18'. The upper and lower surfaces of each support wall and the inner side of each includes an elongated wedge 32 or other suitable connector.

Three divider inner sides 31 having grooved V-shaped vertical edges 52 along with twelve divider walls 34' are provided. Each divider wall has formed along its upper and lower surfaces an elongated wedge 32 which is sized to engage with an appropriate slot 36' formed in one of the upper or lower surfaces of base 22'.

Unit 14' is assembled by positioning base 22' in a desired position. Three support components 48 are then positioned to have elongated wedges 32 on their lower surface engaged in groove 36' locking support components 48 in equally spaced positions on the upper surface of base 22'. An open space separates each support component 48. Three divider sides 31 are inserted into position between adjacent support components 48 by sliding opposing grooves 52 over adjacent corners 18' forming a closed inner area. Divider walls 34' are now positively located by engaging wedges 32 on the lower surface of walls 34' in slots 36' formed on the upper surface of bottom 42.

Another bottom 22' or a top 12 is positioned over the partially constructed unit 14' interfitting slots 36 and 46 with wedges 32, 44 creating eighteen compartments 11.

Again, there may be only a single ground level unit or there may be a plurality of stacked units with the lowermost one being ground level. Alternatively, the above arrangements may be mounted on a podium in an elevated position.

It is noted that each in the arrangements shown in FIGS. 3-5, unit 10 may be formed with walls 24, 34 extending to the center axis of base 22 or they may be formed with inner sides 30 creating an opening or inner space 50. In the arrangement shown in FIGS. 6–9 opening 50 is present. Cover 12 may be formed with or without the opening.

Turning now to FIGS. 10–13, the door arrangement is disclosed.

Each door 41 comprises a generally rectangular slab preferably formed of stone but which could be formed of concrete plastic or metal.

On the back surface or each door is secured an upper and lower locking member 52, 54. Only one each is shown located centrally of and spaced form an upper and lower edge, respectively. It is noted that there may be a plurality of locking units at either the upper or lower positions or both. Further, they could be considerably longer extending over up to 60% of the width of the door back. Also, other suitable structures may be used.

Figure 11:
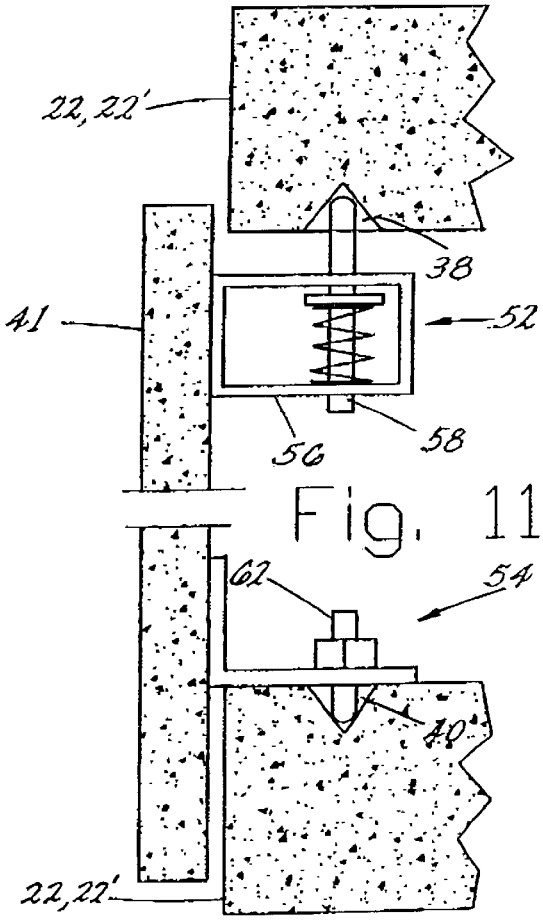
FIG. 11 is an exploded side sectional view of the door latch structure.

Upper locking member 52 comprises a box shaped frame 56 which carries a pin 58 spring biased in an upward direction. Lower locking member 54 comprises an L-shaped frame which carries a stationary pin 62. As shown in FIG. 11, stationary pin 62 engages in groove 40 formed in the upper surface of base 22, 22' while upper pin 58 engages in groove 38 formed in the lower surface of an upper bottom 22 or in the lower surface of top 12. In order to locate door 41 in the locked or closed position, pin 62 is positioned in groove 40, pin 58 is depressed and moved beneath the lower surface of base 22, 22'. The pin is released, the door pivoted into position where pin 58 is biased upward into groove 38 locking the door in position. To remove door 41, simply urge it upward, depressing pin 58 by compressing the spring. In this position pin 62 is elevated above groove 40 and door 41 may be pivoted outward.

Figure 10:
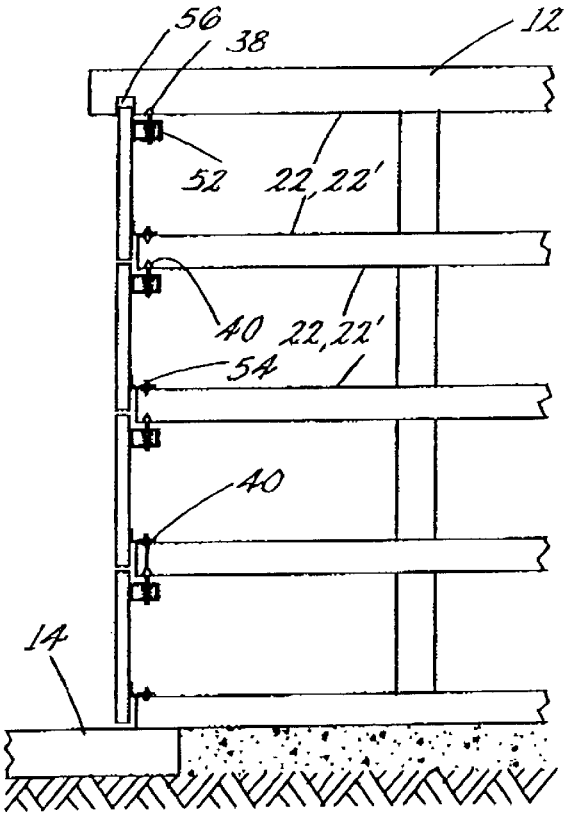
FIG. 10 is a side sectional view of a section of the columbarium with doors in latched position.

As shown in FIG. 10, top 12 is formed to be lightly larger about its circumference than base 22 or 22'. This is to allow an overhang which provides protection from the weather. Because of the overhang, it is necessary to form a channel 56 outwardly of grooves 38. Channel 56 is of a size and is located to be aligned with the upper edge of door 40. The channel provides space to allow door 40 to be elevated during its removal from the opening.

It is noted that doors 40 may include plates 58 which may be engraved to be decorative and for identification. Also, outer facings 60 may be secured with the outer sides to provide an outer finish of desired material. Normally, the outer facings are polished stone, synthetic material, or metal. Top 12 may be molded concrete or it may be formed of stone, metal, or a synthetic material.

As earlier stated, the columbarium of the invention may be formed of pre-molded concrete, may be formed of stone, plastic, metal, or a combination thereof.

While a preferred embodiment of the invention has been described using specific terms, such description is for illustrative purposes only, and it is to be understood that changes and variations may be made without departing from the spirit or scope of the following claims.

What is claimed is:

1. A columbarium comprising:

a multiplicity of vertically stacked interlocked units;

each of said units comprising:

a cover;

a generally planar, hexagonal base having six corners with a plurality of upstanding inner walls arranged over one surface thereof forming a central hexagon shaped inner side having six inner corners;

a plurality of support walls positioned around the perimeter of said inner side defining a plurality of compartments between said base and said cover, each said compartment having an outwardly facing opening;

a respective of said support walls being arranged to extend from each outer corner of said base to an aligned axially inner corner of said inner sides;

a plurality of divider walls, said divider walls being positioned between each adjacent pair of said support walls dividing the space between said support walls into substantially lesser volumes; and, a door for closing each of said opening of said compartments.

2. The columbarium of claim 1 wherein said base is molded from concrete.

3. The columbarium of claim 1 wherein said at least one unit is formed from a material selected from the group consisting of granite, marble, plastic, aluminum, concrete, reinforced concrete, and epoxy concrete.

4. The columbarium of claim 1 wherein the support walls, the peripheral side, and the base are formed integral of a single material.

5. The columbarium of claim 1 wherein the top surface of each support wall of each unit is provided with an interlocking configuration and the bottom surface of each base of each unit is provided with aligned interlocking configurations positioned to mate with the support wall interlocking configuration, whereby bases may be stacked and interlocked with the lower surface of each base forming the cover for the lower unit.

6. The columbarium of claim 1 wherein said cover of the uppermost of said units comprises a hexagonal unit having planar upper and lower surface.

7. The columbarium of claim 1 wherein said inner side extends the height of said plurality of stacked units.

8. The columbarium of claim 1 wherein said units are formed of molded concrete with the thickness of all said vertical walls being less at the top than at the base to facilitate mold release.

9. The columbarium of claim 1 wherein said divider walls are removable for dividing said chambers into different volumes.

10. The columbarium of claim 1 wherein each said outer side of each of said hexagonal units is about three (3) feet in length and the height of each said unit is about one (1) foot.

11. The columbarium of claim 1 wherein the lowermost of said units is supported on a ground level surface.

12. The columbarium of claim 1 wherein the lowermost of said units is supported in an elevated position above ground level.

13. The columbarium of claim 12 including an open faced support podium having a plurality of support walls, said podium supporting said lowermost unit in said elevated position.

14. The columbarium of claim 13 wherein upper surfaces of said podium locks with the lower surface of said lowermost unit.

15. The columbarium of claim 1 wherein each said door comprises:

a permanent, decorative material selected from the group consisting of marble, granite, brass, bronze, aluminum, plastic, glass, fiberglass, lead, masonry, ceramic, and concrete; and, each said door is of substantially the same size.

16. A columbarium comprising:

at least one unit having a base with a center vertical axis and at least five vertical outer faces with each said face being separated from an adjacent of said faces by a corner;

an upstanding support wall with a longitudinal axis extending from each said corner through said center vertical axis;

a cover supported by said support walls and extending slightly beyond outer extremities of said base, said cover forming with said base and said support walls a plurality of compartments with each said compartment having an outwardly directed opening; and, a door for each said opening, said doors closing each said compartment for storage of cremated remains.

17. The columbarium of claim 16 wherein each said door is generally rectangular and of a size slightly larger than said opening which it covers whereby said openings are completely covered with said doors in position.

18. The columbarium of claim 16 wherein each said door includes an inner and an outer surface; and, upper and lower locking members secured with the inner surface of each said door.

19. The columbarium of claim 18 wherein at least one of said locking members include a spring biased pin.

20. The columbarium of claim 19 including locking grooves formed in the lower surface of said cover and the upper surface of said base adjacent each said opening of said compartments;

said upper and lower locking members being adapted to engage in respective of said grooves securing said door in position.

21. The columbarium of claim 20 wherein said door may be raised, compressing said spring of said spring biased locking member, releasing the other said locking member from engagement with said groove and unlocking said door from said opening.

22. The columbarium of claim 20 wherein said lower surface of said cover includes a channel which extends over and across each said opening, said channel being of such a depth as to receive the upper edge of a respective of said doors to allow upward movement of said door for unlocking.

23. The unit of claim 16 wherein at least an outer face of said outer vertical faces include one of granite, marble, brass, and lead.

* * * * *